United States Patent [19]

Petrov et al.

[11] 4,083,204

[45] Apr. 11, 1978

[54] SINGLE PLY HOSIERY WELT AND METHOD OF ATTACHMENT

[76] Inventors: Evgeny Ivanovich Petrov, Belovezhskaya ulitsa, 91, kv. 77; Vladimir Konstantinovich Raevich, Kutuzovsky prospekt, 9, kv. 188; Elena Nikolaevna Kolesnikova, prospekt Budennogo, 1/1, korpus 2, kv. 44; Zinaida Vyacheslavovna Zhernovaya, ulitsa Serafimovicha, 2, kv. 384, all of Moscow; Evgeny Nikolaevich Skvortsov, selo Spass, 214, Krasnogorsk Moskovskoi oblasti; Ljudmila Ivanovna Dagaeva, ulitsa Frunze, 46a, kv. 12, Tula; Jury Prokopievich Korovnikov, ulitsa Leiteizena, 44, kv. 127, Tula; Pavel Anatolievich Agafonov, ulitsa Sedova, 39b, kv. 17, Tula; Alexandr Ivanovich Bystrov, ulitsa Kalinina, 81, kv. 58, Tula; Stanislav Alexeevich Panin, ulitsa Sedova, 39b, kv. 5, Tula; Vasily Trofimovich Agafonov, prospekt Lenina, 62, kv. 89, Tula, all of U.S.S.R.

[21] Appl. No.: 688,998

[22] Filed: May 24, 1976

[51] Int. Cl.[2] ..... D04B 1/26

[52] U.S. Cl. ..... 66/178 R

[58] Field of Search ..... 66/178 R, 172 R, 173, 66/187, 177, 182

[56] References Cited

U.S. PATENT DOCUMENTS

| | | | |
|---|---|---|---|
| 2,098,740 | 11/1937 | Chipman | 66/178 R X |
| 2,170,615 | 8/1939 | Beens et al. | 66/173 |
| 2,263,763 | 10/1941 | Edwards | 66/178 R |
| 2,640,339 | 6/1953 | Dowell | 66/182 |
| 2,747,390 | 5/1956 | Reymes-Cole | 66/173 |
| 3,279,220 | 10/1966 | Cole | 66/187 |

FOREIGN PATENT DOCUMENTS

| | | | |
|---|---|---|---|
| 147,725 | 1/1902 | Germany | 66/173 |

*Primary Examiner*—Mervin Stein
*Assistant Examiner*—Andrew M. Falik
*Attorney, Agent, or Firm*—Steinberg & Blake

[57] ABSTRACT

An article of hosiery and a method of knitting thereof on a circular knitting machine relates to the knitting industry.

The article of hosiery is made up of two parts one of which parts is an ordinary single-ply fabric with an unravelling edge serving as the welt; whereas the second part has a machine-closed end. Each loop of one part is linked with each loop of the other part by ravelling courses arranged on the reverse side of the article along the linking line of the parts. The process of knitting of such an article starts with the knitting of one part of the needles of the circular machine, then the knitted part is shifted along these needles to a non-operating zone and the second part of the article is knitted on the very same needles, meanwhile the already knitted part is held in the non-operating zone of the needles. Thereafter, all loops of the knitted parts are linked by the ravelling courses and the ready-to-wear article is knocked off the needles of the machine, the produced article featuring the pleasing appearance and high service properties.

3 Claims, 7 Drawing Figures

SINGLE PLY HOSIERY WELT AND METHOD OF ATTACHMENT

The present invention relates to the knitting industry, and, more particularly it relates to hosiery and methods of knitting thereof on a circular knitting machine.

At present, there is known a method of knitting of a hosiery of the panty-hose type on a circular knitting machine (cf. Patent of the USSR No. 380020, Cl. D04b 9/46).

In accordance with this method two separate parts are knitted to be thereafter linked by ravelling courses, and knocked-off the needles of the machine.

Knitted first is one leg and panties or a half thereof, then every other needle of the machine is sunk, several ravelling courses are knitted thereon and knocked off, while the loops of the panties are transferred from other needles to the welt hooks and while this part of the article is held on the welt hooks, both the other leg and the half of the panties are knitted on all needles. Then, for this part of the article to be linked with the first part thereof, the loops of the latter hanging on the hooks are transferred to the needles, all needles are engaged and the ravelling courses knitted.

With the described method of knitting on a circular knitting machine realized, the ravelling courses are obtained both on the obverse and on the reverse side of the article, while the knitting process entails the transfer of the loops from the needles to the welt hooks and back which may cause defects in the hosiery.

This impairs the hosiery appearance and, besides, this method may be effected only when knitting the hosiery of the panty-hose type on the machines with the cylinder dial. The circular knitting machines designed for producing socks, as a rule, have no cylinder dials, and therefore these machines cannot be used for the purpose.

There is also known a method of knitting on a circular knitting machine of hosiery, such as socks having one part knitted as a double welt every other loop of which is linked with the loops of the second part of the article having a closed end. The parts of the article are linked by the ravelling courses.

In accordance with this method, the knitting is started from the closed end, then the sole, the heel and the calf of the article are knitted, after which every other loop of one half of the calf loops is transferred onto the welt hooks and held thereon while the welt is being knitted of the cylinder needles.

Thereafter, the loops hanging on the hooks are transferred to the needles and all needles are engaged for knitting the ravelling courses whereby a double welt is produced.

The method of knitting of an article of hosiery on a circular knitting machine described above yields a double welt every other loop of which is linked with the remaining part of the article and the knitting process is connected with the transfer of the loops from the needles to the welt hooks and back which is likely to produce defects in the hosiery. For producing the double welt the additional amount of raw material is required, meanwhile the hygienic and mechanical properties are deteriorated since the double welt exerts pressure on the leg and is inconvenient in usage.

The method described above may be realized only on the machines with the cylinder dial, and therefore it cannot be effected on the machines having no such a dial.

It is an object of the present invention to obviate the disadvantages.

It is an object of the present invention to provide an article of hosiery and a method of knitting thereof wherein the ravelling courses will be arranged only on the reverse side of the article and instead of a double welt an ordinary single-ply fabric with an unravelling edge is produced, as a result of which the pleasing appearance and high service properties of the article will be ensured.

This and other objects are attained in that in an article of hosiery made up of two separately knitted parts linked together by the ravelling or joining courses, in accordance with the present invention, one part of the article is knitted as an ordinary single-ply fabric with an unravelling edge to take the place of a conventional double welt and the other part has a machine-closed end and each loop thereof is linked with each loop of the first part by the ravelling courses arranged on the reverse side of the article along the linking line of the parts.

Linking of each of the loops of the first and second parts of the hosiery by the ravelling courses produces the seam of high quality and strength. The ravelling courses obtained on the reverse side of the article do not impair the appearance of the article and are not perceptible when in wear.

For obtaining the proposed hosiery a method of knitting in accordance with the invention includes knitting on a circular knitting machine two separate parts of the article which are subsequently linked by the ravelling courses and knocked off the needles of the machine.

With this method realized, in accordance with this invention, at first one part of the hosiery is knitted as an ordinary fabric replacing the normal welt and having an unravelling edge and, upon completing the knitting, all loops of the last course thereof are shifted along the shanks of the machine needles to a non-operating zone and the very same needles are thereafter used for knitting the second part of the article with a closed end, while the last formed loops of the first part are held on the needles in the non-operating zone. Then as soon as the knitting of the second part is finished, all loops of the last course of the first part are shifted along the shanks of the needles to the operating zone, arranged close to the loops of the last course of the second part and each loop of the first part is linked with each loop of the last course of the second part by the ravelling courses which appear on the reverse side of the article along the linking line of the parts.

With this method of linking of each of the loops of two separately knitted parts of the article realized, the latter is free from defects and loop press-offs at the place of their linking since the linking of the loops is attained by the shifting thereof along the needles and not by the transfer to another element such as the cylinder dial hooks.

The method is simple, reliable and ensures a seam of high quality. As a result, produced is an article which approximates as much as possible a classical article of hosiery, for instance, the socks.

Given below is a detailed description of the present invention with reference to the accompanying drawings, wherein.

Figure 1:
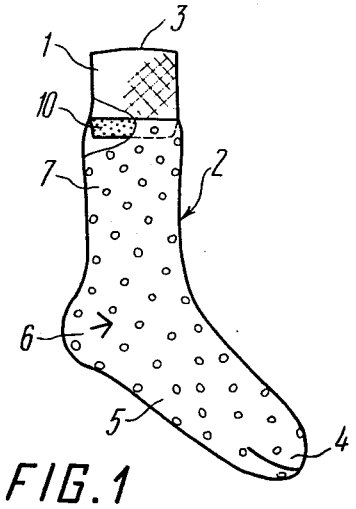
FIG. 1 shows schematically a sock according to the invention.

Referring now to the drawings the article of hosiery, for instance, a sock shown in FIG. 1 is knitted on a circular knitting machine with one set of needles and is made up of two parts 1 and 2, respectively. One part 1 of the article is an ordinary single-ply fabric at the location normally occupied by the welt this fabric having an unravelling (lockstitch) edge 3 and the second part 2 of the article includes a closed end (toe) 4, a sole 5, a heel 6 and a calf 7.

Figure 2:
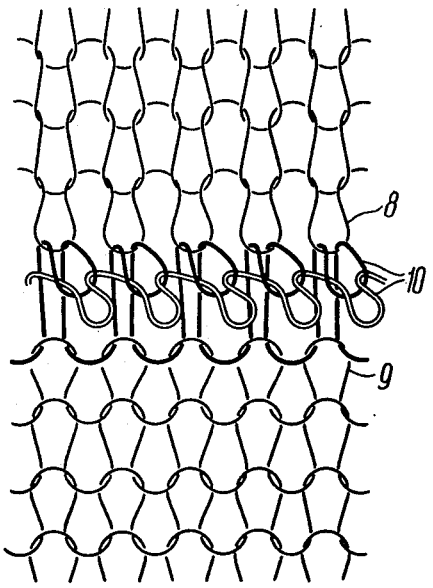
FIG. 2 shows a part of a linked article of hosiery to an enlarged scale.

Each loop 8 of the last course of the part 1 is linked with each loop 9 of the last course of the part 2, as is shown in FIG. 2, by ravelling courses 10 arranged on the reverse side along the linking line of the parts 1 and 2 (FIG. 1).

For producing such an article of hosiery used is, as has already been mentioned, a known circular knitting machine with one set of needles comprising sinkers 11 having two knitting surfaces, namely, a main knitting surface 12 and an auxiliary knitting surface 13.

Figure 3:
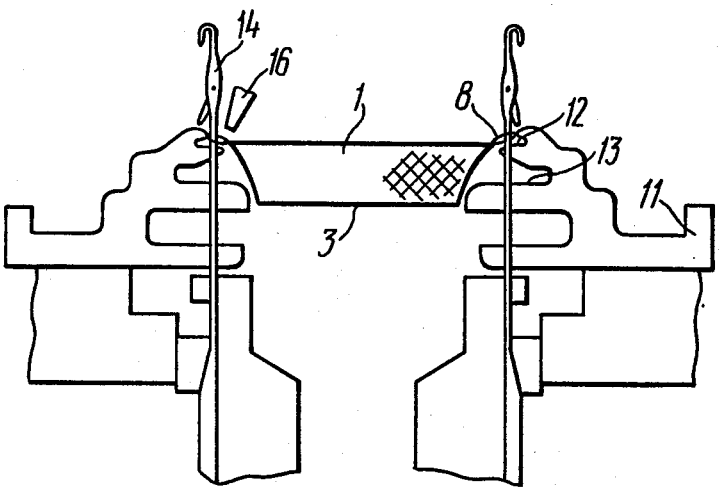
FIG. 3 shows a process of knitting of the first part of the article of hosiery.
Figure 4:
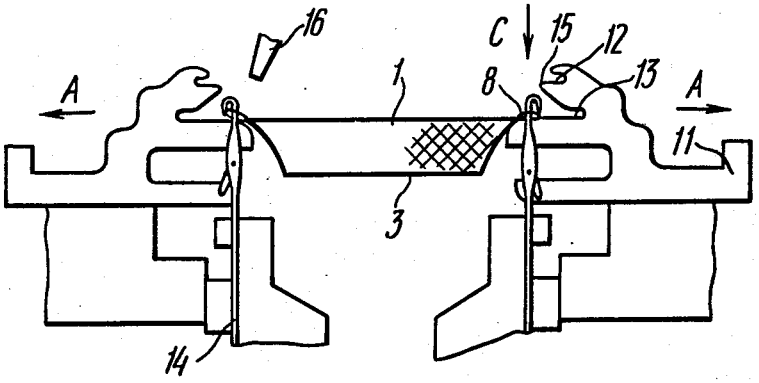
FIG. 4 shows the process of shifting of the loops of the last course of the first part of the article of hosiery to the non-operating zone.
Figure 5:
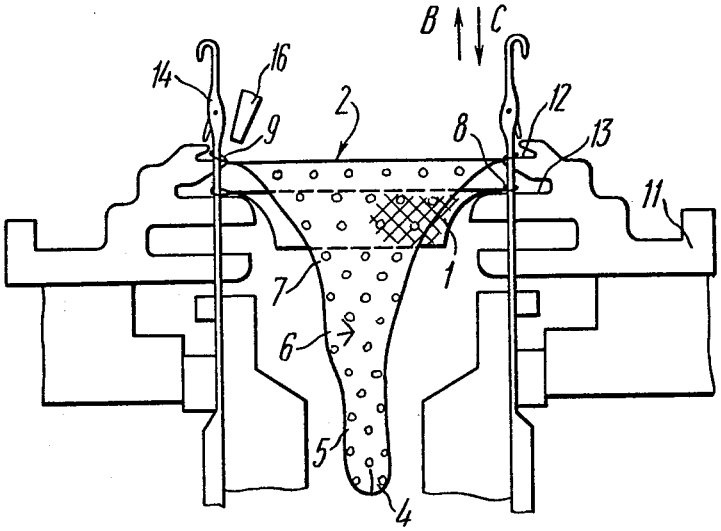
FIG. 5 shows the process of knitting of the second part.

Needles 14 of the circular knitting machine within the operating zone thereof are used to work in a known manner the loops of the first part 1 of the article, that is, an ordinary single-ply fabric to serve as a welt, thereby forming the unravelling (lockstitch) edge 3. After the knitting of the part 1 in a known manner on the main knitting surface 12 is finished, the loops 8 (FIG. 3) of the last course are shifted downwards along the shanks of the needles 14 to the non-operating zone. For this, the sinkers 11 are moved apart in the directions shown by arrows A (FIG. 4) so that a neb 15 of the main knitting surface 12 departs from the zone of interaction with the needles 14 and the needles 14, while sinking, lower the part 1 beneath the neb 15 onto the auxiliary knitting surface 13. After this, the sinkers 11 return to the initial position, the needles rise and the knitted part 1 remains on the needles on the knitting surface 13 (the rise and sinking of the needles are shown by arrows B and C respectively). Thereafter, the very same needles 14 of the machine are used for working the loops of the part 2 of the article starting from the toe 4 whereby the closed toe 4 (FIG. 5) is formed, then the sole 5, the heel 6 and the calf 7 are knitted on the main knitting surface 12 in a known manner, the loops 8 of the welt being held on the same needles 14 of the machine in the non-operating zone, that is on the knitting surface 13, as is shown in FIG. 5.

The knitting of the last course of the part 2 completed, the sinker 11 is again shifted in the direction shown by the arrow A (FIG. 6), as a result of which the knitting surface 12 does not cooperate with the needles 14.

Figure 6:
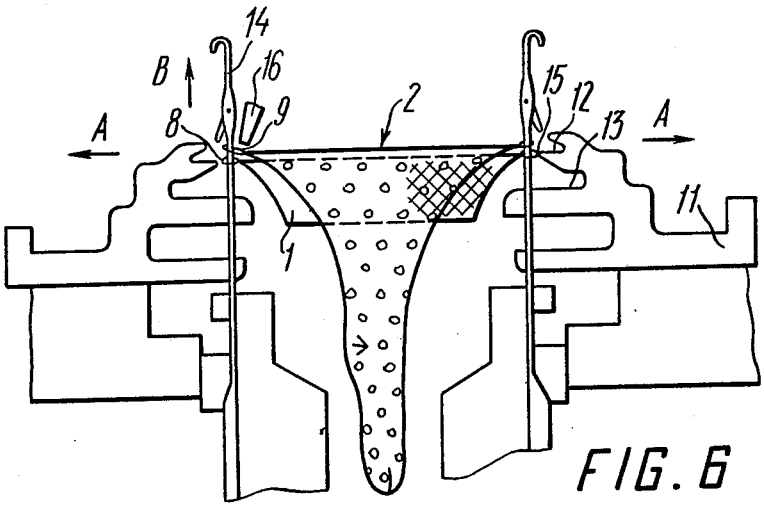
FIG. 6 shows the process of shifting of the first part of the article of hosiery from the non-operating zone to the operating one.

The needles 14, while rising for finishing the knitting, shift the part 1 of the article from the non-operating zone to the operating one level with the main knitting surface 12 and the loops 8 of the part 1 prove to be close to the loops 9 of the part 2, as is shown in FIG. 6. In the process of rising of the needles 14 plates 16 hold the part 2 level with the knitting surface 12.

Figure 7:
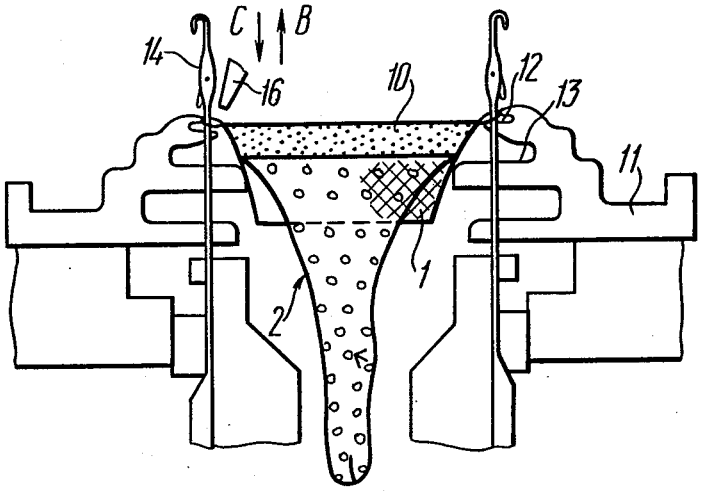
FIG. 7 shows linking of the loops of the last courses of the first and second parts and knitting of the ravelling courses.

Thereupon, the sinkers 11 return to the initial position and the loops 8 and 9 of the parts 1 and 2 are knitted together by the ravelling courses 10 (FIG. 7) whereby linking of the parts 1 and 2 is attained.

After the ravelling courses 10 are knitted on the main knitting surface 12 and all loops are closed, the ready-to-wear article is knocked off the needles 14 of the machine. Thereat, the ravelling courses 10 appear on the reverse side of the article along the linking line of the parts 1 and 2.

What is claimed is:

1. An article of hosiery knitted on a circular knitting machine comprising: a first part of the article which is to serve as a normal welt and is an ordinary single-ply fabric knitted on the circular knitting machine and having an unravelling edge at one end and a last course at the other end comprising loops which are substantially identical in size with loops of adjacent courses; a second part of the article knitted on the circular knitting machine separately from said first part and having a last course of loops substantially identical in size with the loops of adjacent courses and also substantially identical with said loops of said last course and adjacent courses of said first part; and joining courses comprising individual loops of substantially identical construction to the aforementioned loops joining each loop of the last course of said first part with each loop of the last course of said second part and arranged on the reverse side of the article, thereby forming a linking line of the parts, said loops of the last courses of said parts having a stitch length resulting only from the circular knitting thereof.

2. A method of knitting of an article of hosiery on a circular knitting machine wherein the shanks of the needles are the non-operating zone, consisting in that: two separate parts are knitted on the needles of the circular knitting machine, the first of which parts is an ordinary fabric with an unravelling edge and the second part has a machine-closed end, the first part of the article being knitted initially and the loops of the last course thereof being shifted thereafter along the shanks of the needles of the machine to the non-operating zone following which said needles are used for knitting the second part of the article starting from said closed end while the loops of the first part are held in the non-operating zone of the needles; then, after the knitting of the second part is completed, all loops of the last course thereof are left on the needles, whereas all loops of the last course of the first part are shifted along the shanks of the needles to the operating zone and arranged close to the loops of the second part, whereupon each loop of the last course of the first part is linked with each loop of the last course of the second part by the joining courses as a result of which the joining courses appear on the reverse side of the article along the linking line of the parts.

3. An article as recited in claim 1 and wherein said second part includes a machine-closed end forming a toe of the article of hosiery.

* * * * *